US007869613B2

(12) United States Patent
Gebert

(10) Patent No.: US 7,869,613 B2
(45) Date of Patent: Jan. 11, 2011

(54) EARWAX PROTECTION DEVICE AND METHOD HAVING A CONTRASTING OR COLORED MEMBRANE

(75) Inventor: Anton Gebert, Kleinsendelbach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1056 days.

(21) Appl. No.: 11/613,322

(22) Filed: Dec. 20, 2006

(65) Prior Publication Data

US 2007/0154043 A1 Jul. 5, 2007

Related U.S. Application Data

(60) Provisional application No. 60/752,097, filed on Dec. 20, 2005.

(51) Int. Cl.
*H04R 25/00* (2006.01)

(52) U.S. Cl. ..... 381/325; 381/322

(58) Field of Classification Search ..... 381/312, 381/322, 324, 325, 328, 329; 181/129, 130, 181/135; 128/864
See application file for complete search history.

(56) References Cited

U.S. PATENT DOCUMENTS 4,972,488 A 11/1990 Weiss
5,864,628 A * 1/1999 Posen et al. ..... 381/325
5,970,157 A * 10/1999 Yoest ..... 381/325
6,164,409 A 12/2000 Berger
2002/0136420 A1 * 9/2002 Topholm ..... 381/312
2003/0037989 A1 * 2/2003 Widmer et al. ..... 181/130
2005/0018866 A1 1/2005 Schulein et al.

FOREIGN PATENT DOCUMENTS

DE 196 40 796 A1 4/1998

OTHER PUBLICATIONS

Sonion: "C-Barrier", Application Note, Jan. 10, 2005, www.sonion.com.

* cited by examiner

*Primary Examiner*—Tuan D Nguyen
(74) *Attorney, Agent, or Firm*—Schiff Hardin LLP

(57) ABSTRACT

The present invention provides the ability to efficiently detect a defect of an earwax protection device membrane. To achieve this, a high contrast is set between the membrane and the associated carrier. If the membrane is torn, the carrier in the background can then easily be detected. A particularly suited brightness contrast between the membrane and the carrier is >0.1. In the case of a desired high color contrast, the color of the membrane should be spaced apart from the color of the carrier by at least 60° on a blue-yellow-red color circle.

13 Claims, 1 Drawing Sheet

EARWAX PROTECTION DEVICE AND METHOD HAVING A CONTRASTING OR COLORED MEMBRANE

CROSS REFERENCE TO RELATED APPLICATIONS

The present application claims the benefit of U.S. Provisional Application No. 60/752,097, filed Dec. 20, 2005, herein incorporated by reference.

BACKGROUND

The present invention relates to an earwax protection device for a hearing aid or another hearing apparatus, for example, a headset, having a carrier that has a sound passage opening, and a membrane that is tensioned over the sound passage opening to protect against penetrating earwax.

Hearing aids are exposed during daily use to many variable materials that can cause contamination in the hearing aids and, particularly, in the transducers of the hearing aids. Such materials are, in particular, sweat and earwax. Contaminants inside transducers, specifically the microphones, lead to high service costs, since the contaminated transducers must be cleaned and, in the worse case, even replaced due to irreparable damage.

In order to solve this problem, use is frequently made of open earwax protector systems so that the earwax cannot, for example, reach the receiver directly. However, it is not always possible for such open earwax protector systems to prevent the contamination of the receiver.

As an alternative solution, German patent application no. DE 196 40 796 A1 presents a hearing aid in which the receiver is sealed off from the eardrum by a membrane. United States patent publication no. US 2005/0018866 A1 likewise discloses an acoustically transparent contamination shield for audio transducers whereby a protective film is intended to keep solid, liquid and gaseous contaminants away from the acoustic transducer.

Since the protective membranes are very thin for acoustic reasons, they are also very susceptible to damage and destruction. Consequently, there must be a continuous check as to whether the membrane is still intact. However, the problem exists here that the sound opening over which the membrane is tensioned is generally very small, and so damage to the membrane can be perceived optically only with difficulty.

The Sonion company also markets hearing aids whose receiver output is to be protected against earwax by a membrane. The use of a pocket lamp for inspecting this membrane is proposed in an "Application Note", "C-Barrier", dated Jan. 10, 2005, on page 15 at www.sonion.com. When the membrane is intact, it reflects the light of the pocket lamp at the appropriate angle. But if the membrane is contaminated or damaged, the light is not reflected. However, this test method can be executed directly only for a restricted group of persons since it is relatively complicated.

SUMMARY

It is therefore the object of the present invention to provide an earwax protection device that is efficient in establishing whether there is damage to a membrane.

According to various embodiments of the invention, this object is achieved via an earwax protection device for a hearing aid having a carrier that has a sound passage opening, and a membrane that is tensioned over the sound passage opening in order to protect against penetrating earwax, the brightness contrast between the membrane and the carrier being greater than, e.g., 0.1.

Also provided according to various embodiments of the invention is an earwax protection device for a hearing aid having a carrier that has a sound passage opening, and a membrane that is tensioned over the sound passage opening in order to protect against penetrating earwax, the color of the membrane being e.g., spaced apart by at least 60° from the color of the carrier on, e.g., a blue-yellow-red color circle.

According to these embodiments, there is advantageously a contrast between the protective membrane and the carrier that is clearly perceptible to the eye, and so by tearing the membrane, the carrier therebelow becomes visible so that it is easy to detect damage.

The brightness contrast between the membrane and the carrier is preferably greater than 0.3, greater than 0.5, greater than 0.7 or even greater than 0.9, wherein the choice of contrast levels can be made on the basis of cost, appearance or other aesthetics. The stronger the contrast between the two components, the easier it is to establish damage to the membrane. Detecting a defect in the membrane optically thereby becomes substantially simpler than in the case of the transparent membranes normally used.

If the color contrast between the membrane and the carrier is utilized, it can be helpful for the color of the membrane to be spaced apart from the color of the carrier by at least 90° on a standard color circle used in the art community. It is even more advantageous when the two colors are essentially complementary (i.e., spaced apart by 180°). Consequently, even under poor light conditions, it is generally possible for the membrane to be reliably examined.

In a further embodiment, the carrier on which the membrane is mounted can be funnel shaped. Consequently, in the case of a tear, the carrier can be perceived optically behind the greater part of the membrane.

DESCRIPTION OF THE DRAWINGS

The present invention is explained below in more detail with the aid of the attached drawings.

DETAILED DESCRIPTION OF THE PREFERRED EMBODIMENTS

The following exemplary embodiments outlined in more detail constitute preferred embodiments of the present invention.

Figure 1:
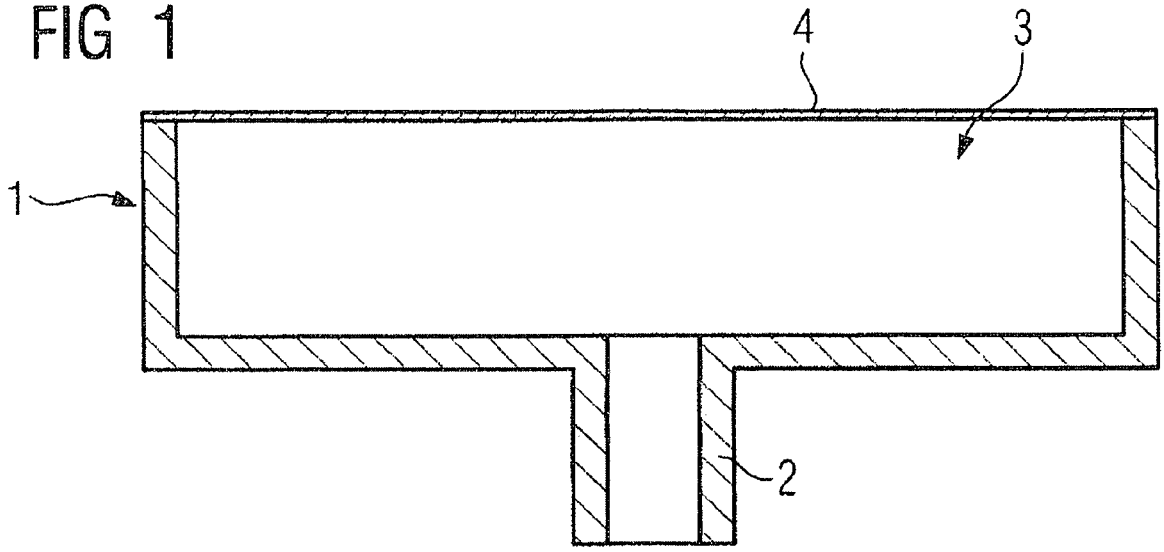
FIG. 1 is a pictorial side view showing a cross section through an inventive earwax protection device.

The earwax protection device illustrated schematically in FIG. 1 has an essentially funnel- or step-funnel-shaped carrier 1. The carrier 1 is plugged onto a sound outlet of a receiver (not illustrated) of a hearing aid with its tapered or smaller end 2. At its opposite end, the carrier 1 has a wide sound opening 3 over which a membrane 4 is tensioned.

The membrane 4 has a dark color, for example, while the membrane carrier 1 is brightly colored. With this construction, It is easy to detect a defect in the membrane 4 via this clear bright/dark contrast, since the light carrier 1 becomes visible through the damaged, dark membrane 4.

The brightness difference between the membrane 4 and the carrier 1 determines the brightness contrast between the two components. The contrast K is defined in general as: $K=(I_{max}-I_{min})/(I_{max}+I_{min})$. Here, $I_{max}$ denotes the luminous intensity of the brighter component, and $I_{min}$ denotes the luminous intensity of the darker component. The luminous intensity itself presents the quotient of luminous flux and solid angle. The term "brightness contrast" used in this document relates to the above definition.

If the membrane and the carrier are equally bright, then $I_{max}=I_{min}$ and therefore K=0. If, nevertheless, one of the two components is black, that is to say $I_{min}=0$, so K=1. The contrast K thus moves in accordance with this definition i.e. between the values 0 and 1.

A physiological contrast $K_{ph}$ can also be considered as an alternative. This is defined as follows: $K_{ph}=(L_{ob}-L_U)/(L_U)$.

Here, $L_{ob}$ denotes the luminance of an object, and $L_U$ denotes the luminance of the surroundings. For the human eye to be able to perceive objects in the surroundings, there must be an appropriate contrast between the object and the surroundings. In the simplest case, this is a difference in luminance. Color differences can also be added to this. The physiological contrast $K_{ph}$ can assume values between −1 and +8. The brightness contrast values can be easily and interchangeably converted into corresponding physiological contrast values. The core idea that there is to be an increased contrast between carrier and membrane remains unaffected thereby.

The brightness contrast just described can be regarded as a physical contrast variant. The human eye can, however, perceive other optical contrasts. Consequently, other contrast definitions in addition to the bright/dark contrast exist, for example in painting, such as: cold/warm contrast, color-perse contrast, complementary contrast, quality contrast, quantity contrast, simultaneous contrast and successive contrast. Irrespective of the type of contrast, the essence of the present invention results in setting an effectively perceptible contrast between the carrier 1 and the membrane 4. This contrast ideally is in the form of a visually discernable attribute.

Figure 2:
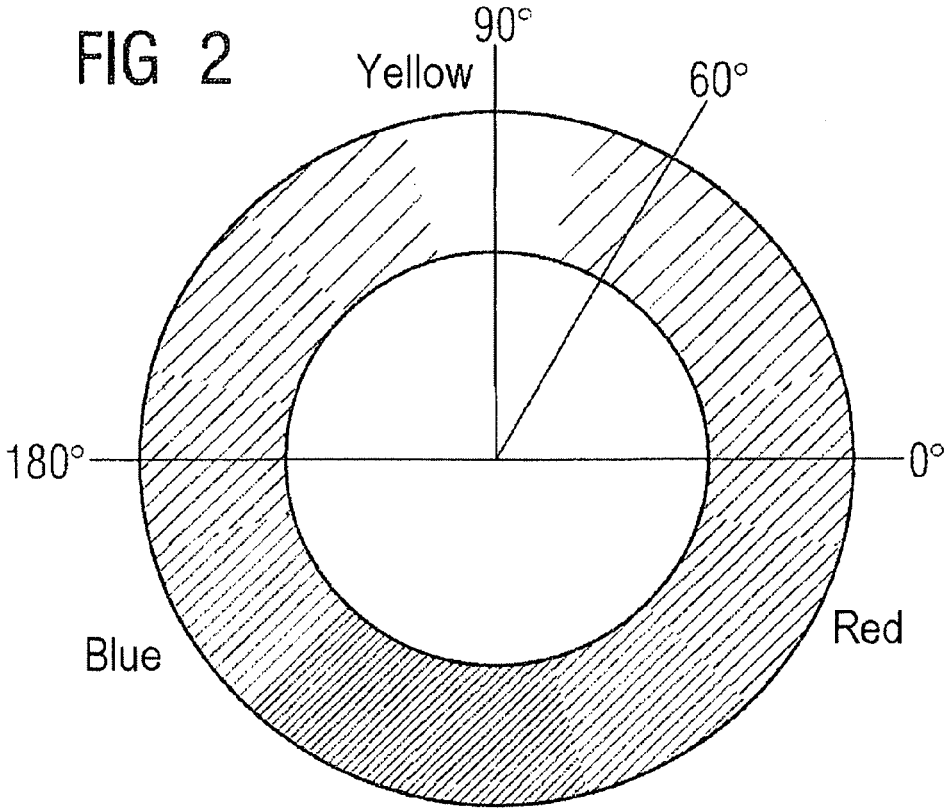
FIG. 2 is a graphical illustration of a blue-yellow-red color circle from the field of art.

In a further exemplary embodiment, the color contrast is used for the purpose of better perception of a defect in the membrane. The blue-yellow-red color circle known and used by artists that is illustrated in FIG. 2 is used to define the color contrast. The three primary colors, blue, red and yellow, lie on the color circle at a spacing of 120°. In order to implement a color contrast sufficient to detect defects, the two colors used ideally should be spaced apart by at least 60°. This is depicted in FIG. 2 for dark and bright orange. Given the spacing of at least 90°, the color contrast is already significantly higher, for example, for dark oranges and yellow. When the colors used for the membrane 4 and the carrier 1 are directly opposite on the color circle (180° separation), two colors are complementary to one another and the greatest color contrast is reached (dark orange and turquoise, in the selected example). A defect in the membrane 4 can then be detected most easily by color.

However high the contrast achieved between the membrane 4 and the carrier 1, the perception of defects in the membrane is clearly facilitated in any event.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The present invention may be described in terms of functional block components and various processing steps. The particular implementations shown and described herein are illustrative examples of the invention and are not intended to otherwise limit the scope of the invention in any way. For the sake of brevity, conventional aspects may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A protection device for a hearing aid, comprising:
a carrier that has a sound passage opening;
a membrane that is tensioned over the sound passage opening in order to protect against penetrating earwax; and
wherein a visual attribute of the carrier and a visual attribute of the membrane are sufficiently different to permit detection of a defect in the membrane, said visual attribute comprising a brightness contrast between the membrane and the carrier is greater than 0.1.

2. The earwax protection device as claimed in claim 1, in which the brightness contrast is greater than 0.3.

3. The earwax protection device as claimed in claim 1, in which the brightness contrast is greater than 0.5.

4. The earwax protection device as claimed in claim 1, in which the brightness contrast is greater than 0.7.

5. The earwax protection device as claimed in claim 1, in which the brightness contrast is greater than 0.9.

6. A protection device for a hearing aid, comprising:
a carrier that has a sound passage opening;
a membrane that is tensioned over the sound passage opening in order to protect against penetrating earwax; and
wherein a visual attribute of the carrier and a visual attribute of the membrane are sufficiently different to permit detection of a defect in the membrane, said visual attribute comprising a color of the membrane being spaced apart by at least 60° from a color of the carrier on a blue-yellow-red color circle.

7. The earwax protection device as claimed in claim 6, in which the colors are spaced apart by at least 90° on the color circle.

8. The earwax protection device as claimed in claim 6, in which the two colors are essentially complementary.

9. The earwax protection device as claimed in claim 1, wherein the carrier is of a funnel-shaped design.

10. The earwax protection device as claimed in claim 6, wherein the carrier is of a funnel-shaped design.

11. The earwax protection device as claimed in claim 1, wherein the carrier is of a step-funnel-shaped design.

12. The earwax protection device as claimed in claim 6, wherein the carrier is of a step-funnel-shaped design.

13. A protection device for a hearing aid, comprising:
a carrier that has a sound passage opening;
a membrane that is tensioned over the sound passage opening in order to protect against penetrating earwax; and
wherein a visual attribute of the carrier and a visual attribute of the membrane are sufficiently different to permit detection of a defect in the membrane.

* * * * *